US008562405B2

(12) United States Patent
Tam

(10) Patent No.: US 8,562,405 B2
(45) **Date of Patent: *Oct. 22, 2013**

(54) GAMING SYSTEM AND A METHOD OF GAMING

(75) Inventor: Billy Ho Ching Tam, East Killara NSW (AU)

(73) Assignee: Aristocrat Technologies Australia Pty Ltd (AU)

( * ) Notice: Subject to any disclaimer, the term of this patent is extended or adjusted under 35 U.S.C. 154(b) by 0 days.

This patent is subject to a terminal disclaimer.

(21) Appl. No.: 13/454,672

(22) Filed: Apr. 24, 2012

(65) Prior Publication Data

US 2012/0264502 A1 Oct. 18, 2012

Related U.S. Application Data

(63) Continuation of application No. 11/866,182, filed on Oct. 2, 2007, now Pat. No. 8,182,322.

(30) Foreign Application Priority Data

Oct. 9, 2006 (AU) ..... 2006905603

(51) Int. Cl.
*A63F 9/24* (2006.01)

(52) U.S. Cl.
USPC ..... 463/13

(58) Field of Classification Search
USPC ..... 463/13
See application file for complete search history.

(56) References Cited

U.S. PATENT DOCUMENTS

| | | | | |
|---|---|---|---|---|
| 6,149,156 | A * | 11/2000 | Feola | 273/292 |
| 7,017,909 | B1 * | 3/2006 | Awada | 273/292 |
| 2009/0239639 | A1 * | 9/2009 | Yoshizawa | 463/20 |

* cited by examiner

*Primary Examiner* — Corbett B Coburn
(74) *Attorney, Agent, or Firm* — McAndrews, Held & Malloy, Ltd.

(57) ABSTRACT

A gaming system comprising a symbol selector that selects, in a first play round, a first symbol to form a part of a first player hand including a plurality of symbols and a second symbol to form a part of a second player hand including a plurality of symbols, and in each subsequent play round, a replacement symbol for modifying one of the first player hand or second player hand. An outcome generator determines for each play round whether the game is completed or should proceed to a subsequent play round based on a ranking of one of the first player hand and the second player hand being higher than the other of the first player hand and the second player hand for at least two consecutive play rounds. The ranking of the first and second player hands is derived from the symbols of the hands.

10 Claims, 6 Drawing Sheets

GAMING SYSTEM AND A METHOD OF GAMING

RELATED APPLICATIONS

This application is a continuation of U.S. application Ser. No. 11/866,182 filed Oct. 2, 2007, now U.S. Pat. No. 8,182,322, and claims priority to Australian Patent Application No. 2006905603, having a filing date of Oct. 9, 2006, entitled "A Gaming System and a Gaming Method", which is hereby incorporated by reference herein in its entirety.

FEDERALLY SPONSORED RESEARCH OR DEVELOPMENT

[Not Applicable]

MICROFICHE/COPYRIGHT REFERENCE

[Not Applicable]

FIELD OF THE INVENTION

The present invention relates to a gaming system and a gaming method.

BACKGROUND OF THE INVENTION

Gaming systems are required to maintain player interest. There is a continuing need to develop new gaming systems in order to provide interest for players.

BRIEF SUMMARY OF THE INVENTION

In a first aspect, the invention provides a gaming system comprising:

a symbol selector arranged to select, in a first play round, at least one first symbol to form at least part of a first player hand comprised of a plurality of symbols and to select at least one second symbol to form at least part of a second player hand comprised of a plurality of symbols, and arranged to select, in each subsequent play round, at least one replacement symbol for modifying one of the first player hand or second player hand; and an outcome generator arranged to determine for each play round whether the game is completed or whether the game should proceed to a subsequent play round based on a ranking of one of the first player hand and the second player hand being higher than the other of the first player hand and the second player hand for at least two consecutive play rounds, the ranking of the first and second player hands being derived from the symbols of the hands.

In one embodiment, the symbol selector selects a plurality of first symbols and a plurality of second symbols that respectively form the whole first and second player hands.

In one embodiment, the symbol selector selects at least one shared symbol that may be shared by the first and second players to form their respective hands.

In an embodiment, the gaming system comprises a prize allocator arranged to allocate a prize to a first player if the first player hand is ranked higher when the game is completed.

In an embodiment, the first player is a human player and the second player is an automated player provided by the gaming system (the "house"). With this embodiment, no prizes are awarded to the house and the prize allocator is arranged only to allocate a prize to the first player.

In another embodiment, the second player is a human player and the prize allocator is arranged to allocate a prize to the second player if the second player hand is ranked higher when the game is completed.

In an embodiment, the gaming system comprises a replacement determiner for determining for at least the house which one or more of the symbols of a hand should be replaced.

In an embodiment, the gaming system comprises a replacement selector to enable a player to select the symbols to be replaced.

In an embodiment, the outcome generator determines a game to be completed if one hand is higher for two consecutive play rounds.

In an embodiment, the symbols are symbols on dice.

In an embodiment, the player obtains five symbols to form a hand.

In one embodiment, the first player is entitled to obtain more than one first player hand and each first player hand is compared to the house hand.

In one embodiment, if the first and second player hands have an equivalent ranking, the game is completed as a draw.

In another embodiment, both the first and second players obtain at least one replacement symbol in the case of a draw.

Certain embodiments of the invention also provide a gaming method comprising:

- conducting a first play round comprising:
  - selecting at least one first symbol to form at least part of a first player hand comprised of a plurality of symbols;
  - selecting at least one second symbol to form at least part of a second player hand comprised of a plurality of symbols;
  - determining which of the hands has a lower ranking from the symbols of the hands;
  - conducting at least one subsequent play round comprising:
  - modifying the current lower ranked hand by replacing at least one symbol with at least one replacement symbol;
  - determining which of the first player hand and second player hand is ranked lower subsequent to the revision; and
  - determining whether the game is completed or whether the game should proceed to a further subsequent play round based on a ranking of one of the first and second player hands being higher than the other of the first and second player hands for at least two consecutive play rounds.

In an embodiment, the method comprises allocating a prize to a first player if the first player hand is ranked higher when the game is completed.

Certain embodiments of the invention also provide computer program code which when executed by a computer causes the computer to carry out a computer implemented gaming method comprising:

- conducting a first play round comprising:
  - selecting at least one first symbol to form at least part of a first player hand comprised of a plurality of symbols;
  - selecting at least one second symbol to form at least part of a second player hand comprised of a plurality of symbols;
  - determining which of the hands has a lower ranking from the symbols of the hands;
  - conducting at least one subsequent play round comprising:

modifying the current lower ranked hand by replacing at least one symbol with at least one replacement symbol;

determining which of the first player hand and second player hand is ranked lower subsequent to the revision; and determining whether the game is completed or whether the game should proceed to a further subsequent play round based on a ranking of one of the first and second player hands being higher than the other of the first and second player hands for at least two consecutive play rounds.

Certain embodiments of the invention also provide a computer readable storage medium or a data signal having the above computer code thereon.

BRIEF DESCRIPTION OF SEVERAL VIEWS OF THE DRAWINGS

Certain embodiments of the invention will now be described in relation to the following drawings in which.

DETAILED DESCRIPTION OF THE INVENTION

Figure 1:
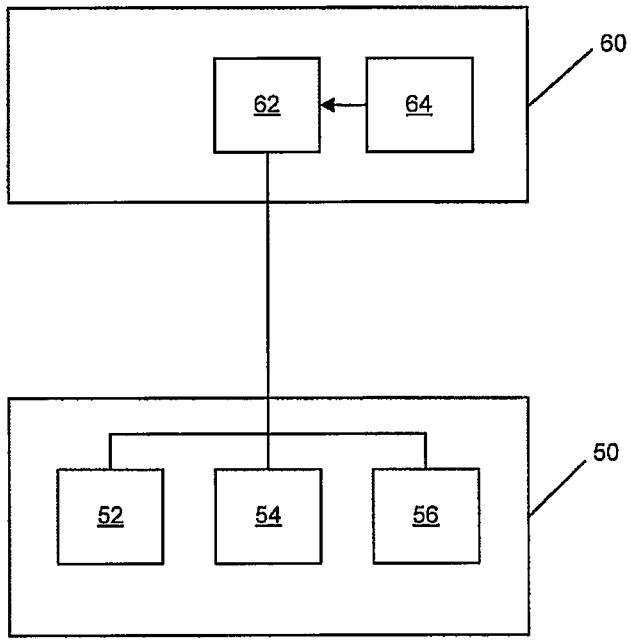
FIG. 1 is a block diagram of the core components of a gaming system.

Referring to the drawings, there is shown a gaming system arranged to implement a game where a player tries to beat the house over a series of play rounds. Each of the player and the house obtains a hand comprising a plurality of symbols. The hands are then compared with one another in order to determine which is higher ranked. The lower ranked hand is then revised by at least one replacement symbol and the hands are compared again. If the same hand is ranked lower after the revision, the game is completed with the higher ranked hand winning. If the other hand is ranked lower after the revision, a further revision takes place. The process of comparison and revision continues until a hand is ranked lower for two consecutive hands. The gaming system can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system comprises several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54 and a game play mechanism 56 that enables a player to input game play instructions.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
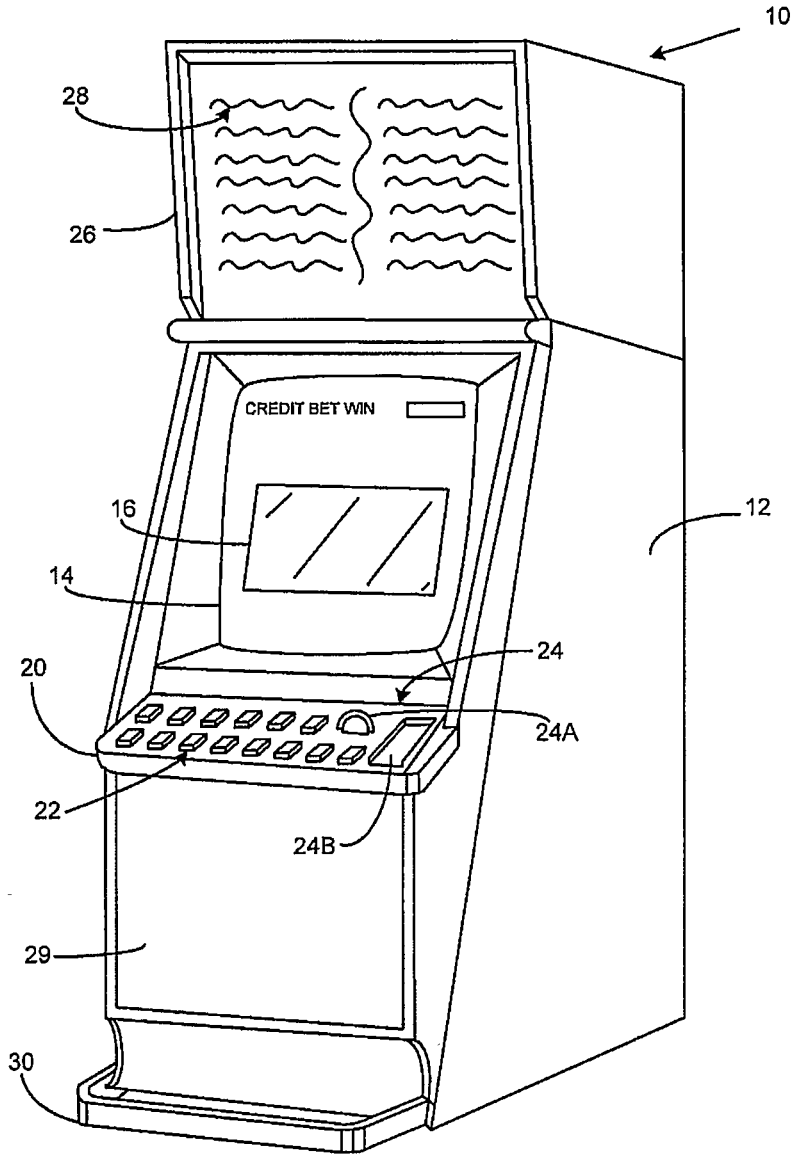
FIG. 2 is a perspective view of a gaming machine.

A gaming system in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, or any other suitable video display unit. The top box 26 may also include a display, for example a video display unit, which may be of the same type as the display 14, or of a different type.

Figure 3:
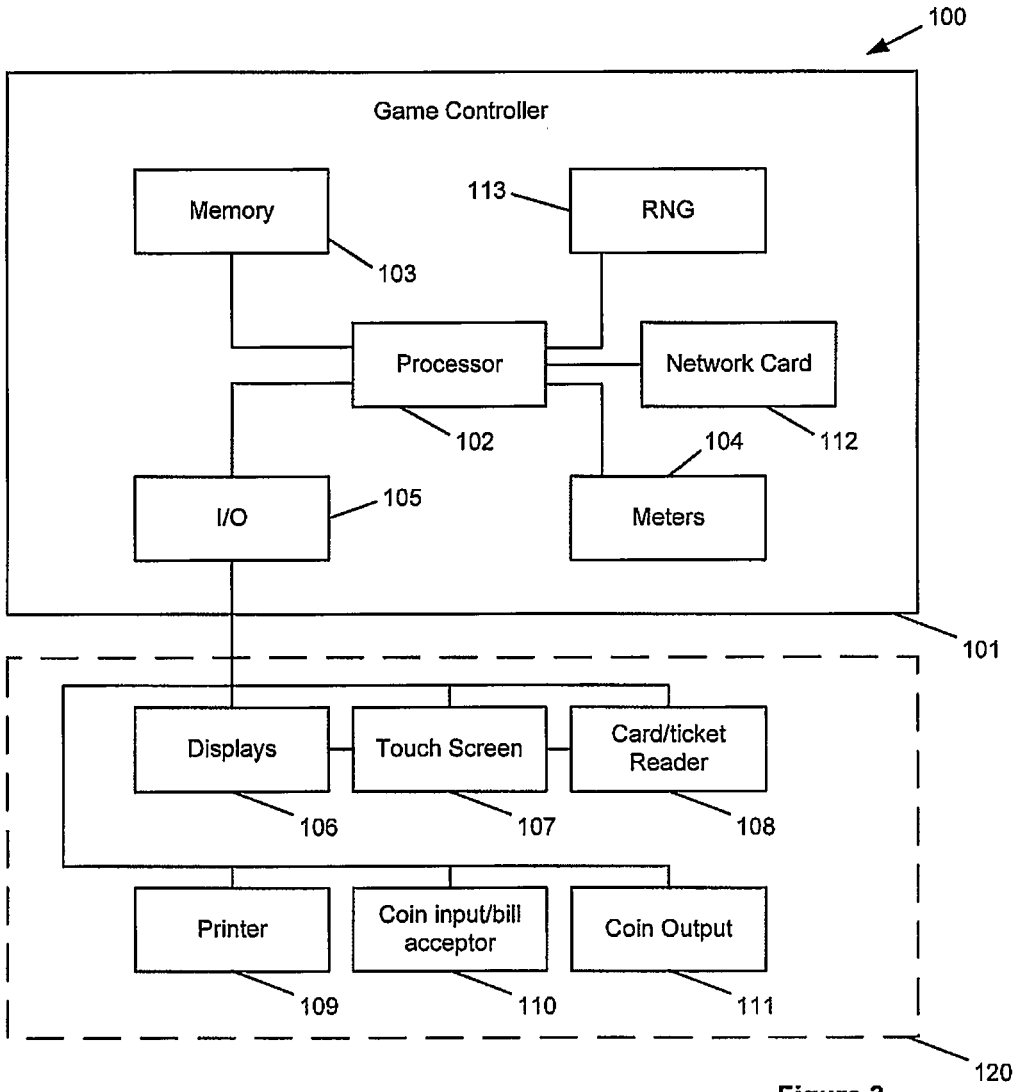
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (UO) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 3, a player interface 120 includes peripheral devices that communicate with the game controller 101 comprise one or more displays 106, a touch screen 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
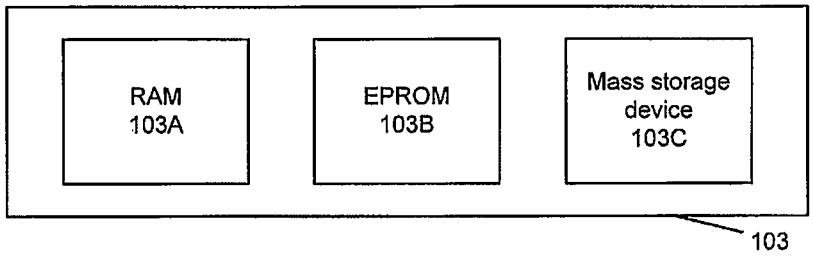
FIG. 4 is a block diagram representing the structure of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
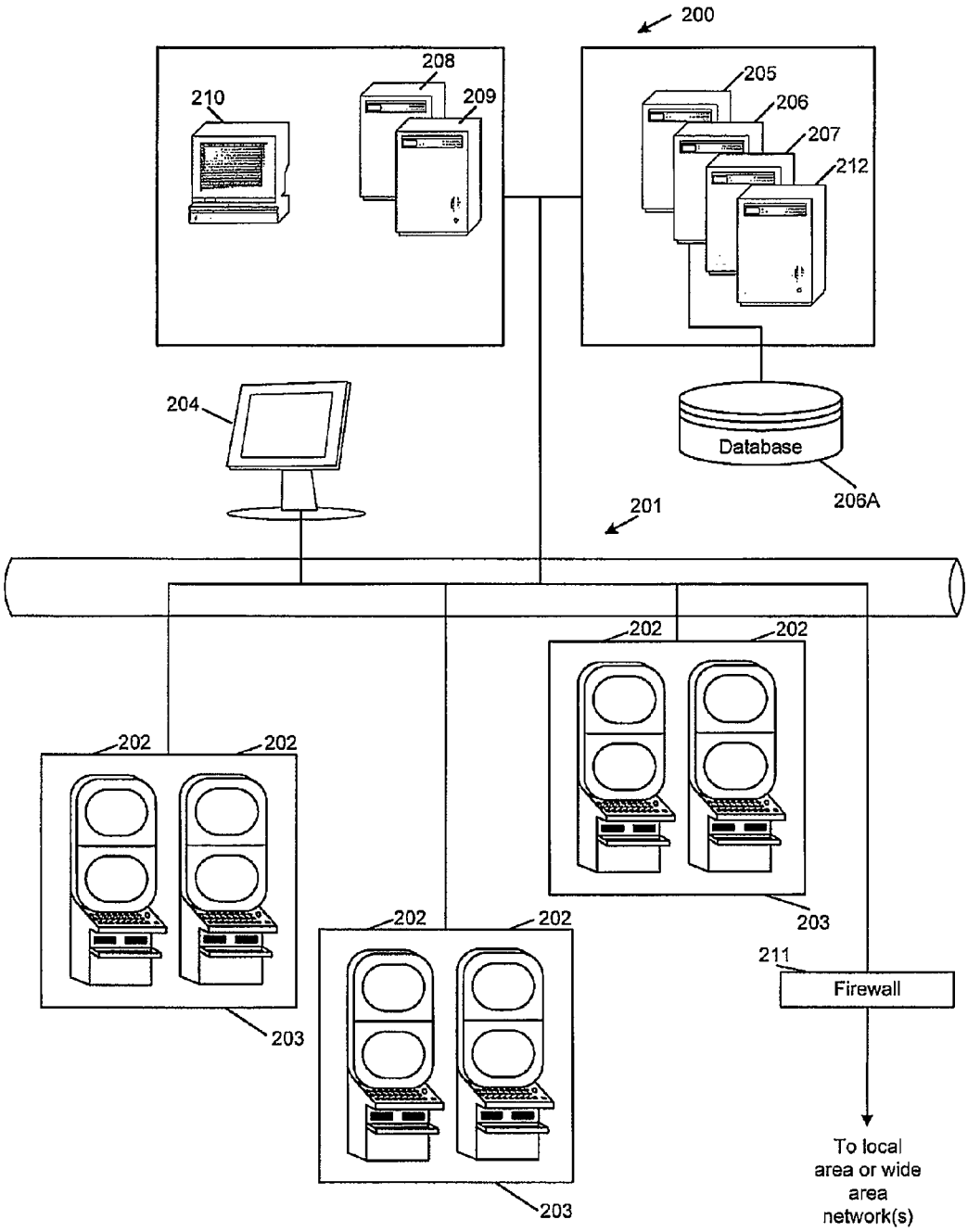
FIG. 5 is a diagram schematic of a networked gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10, 100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to carry out the accounting functions in respect of the jackpot game. A loyalty system 212 may also be provided.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming system 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games as required by the terminals.

Figure 6:
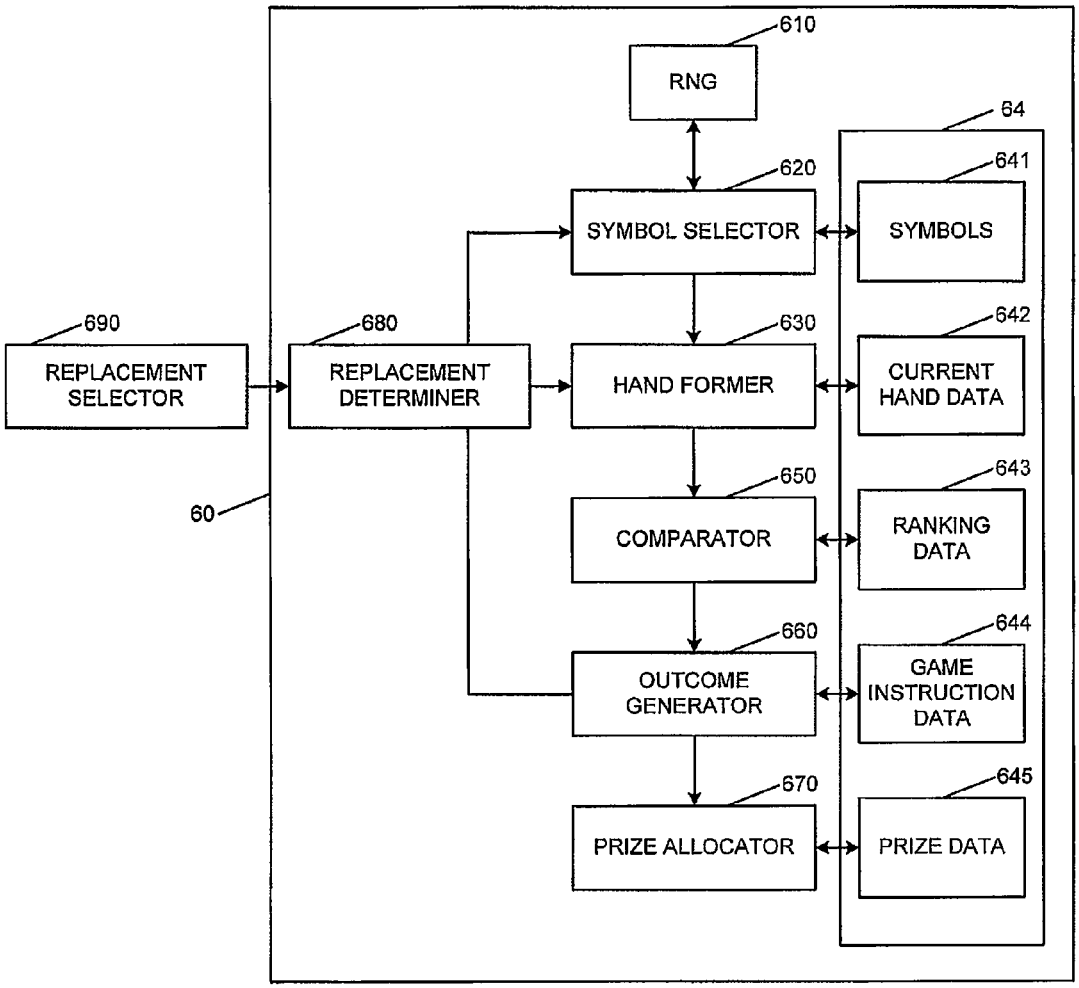
FIG. 6 is a functional block diagram showing detailed components of a game controller.

A game controller 60 of an embodiment is shown in FIG. 6. This embodiment is described in relation to a game where a first player is a human player playing a gaming machine and the second player is the gaming machine, hereafter referred to respectively as the player and the house. In an embodiment, if the player beats the house, the player wins a prize.

For illustrative purposes, an embodiment is described in relation to an example where the symbols are provided on a set of dice. In the game, display of the game outcome involves an animation of throwing the set of dice such that the symbols on one set of dice form a player's hand and the symbols on another set of dice are the house hand. The display that is animated is based on the symbols selected by symbol selector 620. The symbol selector uses a random number obtained from random number generator 610 to select one of symbols 641 stored in memory 64.

The game controller includes a hand former 630 that forms hands comprised of the requisite number of symbols, in this example, five, for the player and the house. The hand former 630 stores the current symbols that make up each of the hands as hand data 642 in memory 64. A comparator 650 compares the player and house hands based on ranking data 643 to determine which hand is ranked higher and hence which hand is ranked lower, or whether both hands have the same or equivalent ranking. The game is intended to proceed to at least a second play round. An outcome generator 660 determines whether the game is completed or whether another round should commence based on game instruction data 644. The owner of the low ranked hand, whether it is the player or the house is entitled under the rules of the game to obtain one or more replacement symbols provided their hand has not been ranked as the lower ranked hand in two consecutive rounds. The outcome generator updates either a counter or flag register (not shown) or a counter in order to store which hand has been ranked lower, and/or how many consecutive rounds they have been ranked lower.

A replacement determiner 680 determines which of the symbols should be replaced either automatically (e.g. for the house) or based on player input. In the preferred embodiment, if the house has the lower ranked hand, the replacement determiner 680 applies a set of game rules for determining which symbol should be replaced in the current hand. The replacement determiner 680 advises the symbol selector 620 as to how many replacement symbols need to be generated and the hand former 630 as to which symbols in the current hand data should be replaced. The hand former 630 updates the hand after it is supplied with the replacement symbols and updates the current hand data 642. In the case of a human player, a replacement selector 690 that forms part of the player interface 50 is used to enable the player to select which symbols are to be replaced and provides these selections to the replacement determiner. (Persons skilled in the art will appreciate that the player's selections could be provided directly to the hand former.) In an optional embodiment, the player can instruct the replacement determiner to select based on a set of rules which symbols to replace. The replacement determiner 680 may be configured to allow all the symbols to be replaced or provide a limit on the number of symbols that can be replaced. Once the replacement determiner 680 instructs the hand former 630 and the symbol selector 620 to replace symbols of the player and/or house hand, the current hand data is updated 642 in case this is needed in subsequent player rounds.

The comparator 650 determines based on the ranking data 643 which hand, including any replacement symbols, is now ranked lower. The outcome generator 660 determines whether the game is completed or should proceed to another play round based on whether the hand that is now ranked lower is the same as the hand that is ranked lower in the previous round. Thus, if the same hand is ranked lower in two consecutive rounds, the outcome generator 660 determines the game as being completed. If the higher ranked hand is the player's hand, the outcome generator instructs the prize allocator 670 to award a prize to the player based on prize data 645. If the hand that is ranked lower has changed, the game proceeds to another play round where the replacement determiner 680 determines either based on rules or on player input from replacement selector 690 which symbols are to be replaced in the next play round. The game continues until either the player or house hand is ranked lower for two consecutive rounds.

The symbol set from which replacement symbols is selected will vary from embodiment to embodiment. In some embodiments replacement symbols may be from the entire set of symbols from which the original or any other earlier selection was made. In other embodiment, symbols which have been previously been selected may be excluded from subsequent selections.

Depending on the specific implementation of an embodiment, there are two ways of resolving cases of equal rankings. In a first case, the game ceases and the prize schedule defines the applicable reward, for example, return of the player's credits. In a second case, both house and player obtain replacement symbols.

Persons skilled in the art will appreciate from the above description that the game controller has a series of modules 610,620,630,640,650,660,670,680 which will typically be implemented by sub-routines of program code stored in memory 64 and executed by processor 62. Persons skilled in the art will appreciate that such program code could be supplied on a computer readable medium such a disk or an EPROM or as a data signal. Persons skilled in the art will appreciate that the various modules could be provided as dedicated hardware modules too.

It will be appreciated that leaving aside the case of draws, the game will generally proceed as follows:

Round 1—Bet has been Placed and First Hands Thrown.

If the player's hand 1 is ranked above the house hand 1 (P1>H1), then the house can choose to hold some dice and re-throw other dice to form house hand 2 (H2).

If the player's hand 1 is ranked lower than the house hand 1 (P1<H1), then the player can choose to hold some of the player's dice and re-throw other dice to form player hand 2 (P2).

Round 2—First Re-Throw is Completed.

If the player's hand 1 is ranked above the house hand 2, (P1>H2) then the player wins.

If the player's hand 1 is ranked below the house hand 2, (P1<H2) then the player re-throws to form the players hand 2 (P2).

If the player's hand 2 is ranked above the house hand 1, (P2>H1) then the house re-throws to form house hand 2 (H2).

If the player's hand 2 is ranked below the house hand 1, (P2<H1) then the player loses.

The process can continue ad infinitum and in general this can be reduced to four possible events:—

If house hand "j" is formed and player hand "j" already exists there are two possible outcomes—

1. If player hand j is ranked above house hand j, then player wins.

2. If player hand j is ranked below house hand j, then player hand j+1" is formed.

If Player hand "j" is formed and house hand "j" already exists there are two possible outcomes—

1. If Player hand j is ranked higher than house hand j then house hand "j+1" is formed.

2. If Player hand j is ranked below house hand j, then the player loses.

In algebraic notation this is $P_j/(P_{j-1}<H_j)$ then if $P_j>H_j$, form $H_{j+1}$ $P_j/(P_{j-1}<H_j)$ then if $P_j<H_j$, player loses $H_j/(P_j>H_{j-1})$ then if $P_j>H_j$, player wins $H_j/(P_j>H_{j-1})$ then if $P_j<H_j$, form $P_{j+1}$ It will be appreciated from the above that the ranking data and hand former 630 specify how the symbols on the dice can form a hand. The symbols on the dice can be numbers, for example, 1 to 6 on six sided dice or any other symbols that can be formed into a hand.

Figure 7:
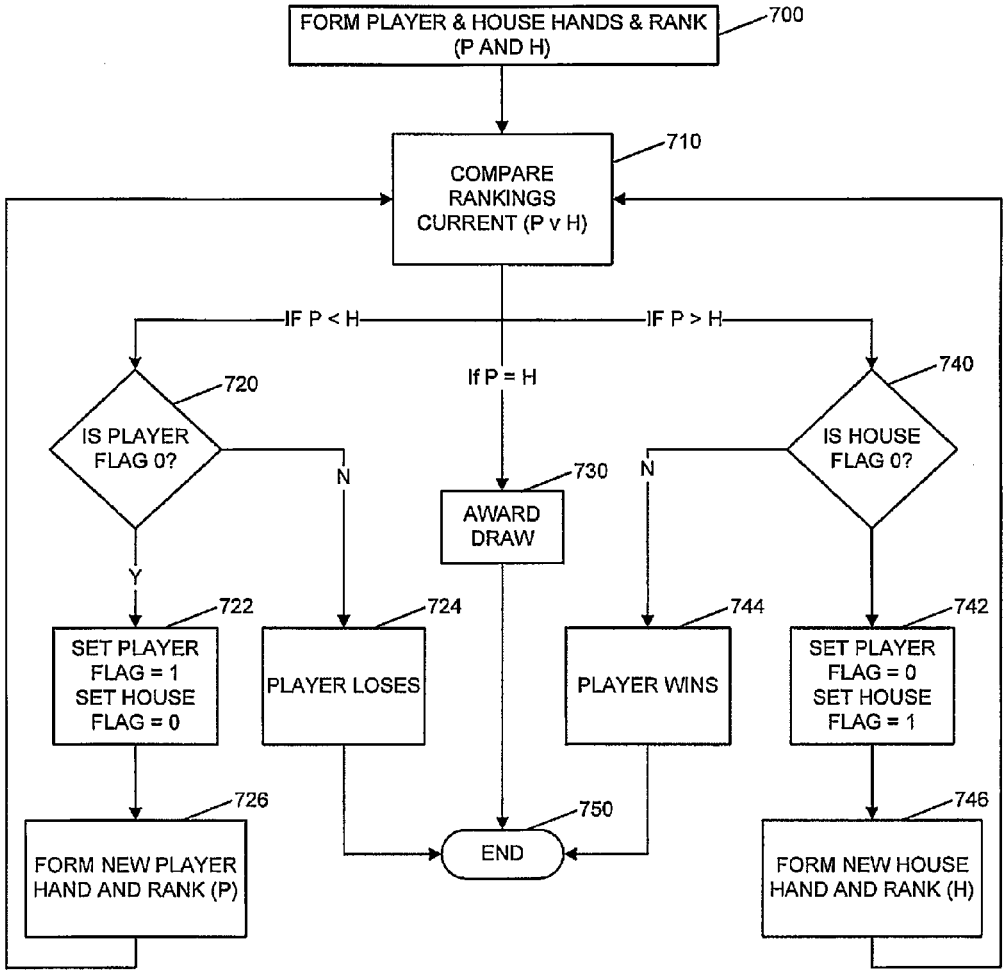
FIG. 7 is a flow chart showing the method of an embodiment.

The method of an embodiment is illustrated in the flow chart of FIG. 7. At step 700, the method involves forming player and house hands and ranking them. At step 710, the rankings are compared. If the rankings are the same, the method proceeds to step 730 and a draw is awarded and the game ends at step 750. If the player's hand is less than the house hand, the method proceeds to determine at step 720 whether a player flag is set to zero. If the player flag is set to zero, this means that there is no previous hand where the player's hand has been ranked lower. If the player hand is not zero, it is determined at step 724 that the player loses and the game ends 750. If the player flag is zero, at step 722 the method involves setting the player flag to one and the house flag to zero. At step 726, replacement symbols are obtained and a new player hand is formed and ranked. At step 710, the revised player rankings and the original house rankings are compared. If it was determined that the player's hand is greater than the house hand ranking, at step 740, the method involves determining whether the house flag is zero and at step 744 the player wins if the house was previously ranked lower as indicated by the flag being one. If the flag is zero, the method proceeds to step 742, the player flag is set to zero and the house flag set to one. At step 746, a new house hand is formed and ranked so that it can be compared at step 710. The process continues until one of the hands is ranked higher for two consecutive rounds.

It will be appreciated by persons skilled in the art that a number of dice allocated to the player in house can be varied. However, in certain embodiments, the player and house have the same number of dice.

In an alternative embodiment, the symbol selector 620 can select some shared symbols which are available for use by the player and house to form a best hand. In this embodiment, the hand former 630 may include a function to determine the best hand for the house and optionally the player. There may also be provided a user input to enable the player to select which of the shared symbols they wish to select to form part of their hand. Depending on the embodiment, the shared symbols may or may not be replaceable.

In one embodiment, the symbols can include a wild symbol that can be used in place of any of the symbols that form part of the normal rankings.

In another embodiment the player can increase their bet in order to increase the prize schedule. Further, in a further embodiment the player can purchase more than one set of dice and play a series of games against the house concurrently. As indicated above the house can be replaced by a second human player in which case there is a method to evaluate each of the hands and rank the hands and display the rankings to the group of players.

In a two player game, play continues until either the first or second players' hand has been ranked lower for two consecutive games. In a game where there are more than two players, players are eliminated one at a time if their hand is ranked lowest for two consecutive games.

Using two consecutive hands consisting of a lower ranking as the way to decide that a player has lost the game provides a reasonable balance between allowing the player a further chance and ending the game in a timely fashion. However, it will be appreciated that it could be requirement that the player's hand needs to be ranked lowest for a larger number of hands, for example, three hands. In some embodiments, there may be a limit as to the number of hands that can be re-thrown. In this case, the prize schedule will define the winning outcome if the hands reach the limit and the outcome generator will determine that the game has been completed based on reaching the predetermined limited number of hands. In some embodiments, the selection of a specific symbol to be shown on the face of the dice may not be directly proportional to the probability of the chance of seeing the symbol on a die. That is, some symbols may be more likely to come up than others and not based on the normal expected one in six probability of a six sided die.

In an embodiment, the player may be provided with assistance by the replacement determiner 680 as to which way of proceeding is most likely to result in a positive game outcome.

In an embodiment, in particular circumstances, the player may be able to increase their bet and split their dice into two groups and obtain additional symbols to supplement those two groups. In another embodiment, the player may be required to place an additional bet to obtain access to additional features like these.

The prizes awarded to a player are the types of prizes well known in the industry including but not limited to credits, cash, progressive or non-cash prizes, feature games.

In an alternative embodiment, additional prizes can be awarded for specific outcomes on the dice. For example, if all dice show 6, a bonus prize can be paid. The game can be played with balls or cards instead of dice as described in further detail below.

EXAMPLES

Example 1

This is a game played with 10 six sided dice. The game is fair and each dice has the numbers 1 to 6 on the faces. The number of throws is unlimited.

Rankings of numbers is defined by the game designer that 6 ranks above 5, ranks above 4, ranks above 3, ranks above 2, above 1. (Note that 1 is regarded strictly 10 as 1 and not as an Ace which would rank above 6.)

A player bets 1 credit.

Five dice are thrown to show five symbols for the house. The result is 1, 2, 1, 3, 5.

Five dice are thrown to show five symbols for the player. The result is 2, 3, 6, 4, 1.

The five symbols for the house and the player are compared to the ranking schedule. (See Table 1)

The house has 1 pair (pair of 1's); the player has no pattern defined on the schedule.

The house hand is ranked higher than the player's hand.

The player is now entitled to re-throw.

The player's hand has 4 to straight (1, 2, 3, 4) so the player can elect to re-throw the die which shows "6" with the aim of getting a "5" to form a straight or a 1, 2, 3 or 4 to form 1 pair. Other re-throws are possible.

The outcome of the re-throw is a "4". The player now has a pair of 4's. The player's hand now beats the house hand. (Pair of 4's beats a pair of 1's.)

The house is now entitled to re-throw.

The house has a pair of 1's and 4 to an outside straight (1, 2, 3, 5). The house can hold the pair and re-throw the three remaining dice OR the house can hold the dice and re-throw one die with a "1".

The house chooses to hold the pair and re-throws the remaining dice. The outcome is 4, 5, 6. The house has only a pair of 1's.

A pair of 4's beats a pair of 1's (as defined by the Ranking Schedule of Table 1).

The player beats the house.

The player wins.

The award to the player is determined by reference to the prize schedule (Table 2).

TABLE 1

| Ranking Schedule |
|---|
| 5 of a kind |
| 4 of a kind |
| Full house |
| Straight |
| 3 of a kind |
| 2 pairs |
| 1 pair |

TABLE 2

| | |
|---|---|
| Player beats house | win = 2 credits per credit bet. |
| [104] Player equals house | win = 1 credit per credit bet. |

Example 2

A game is played with initially ten balls drawn from a large pool of balls. Each ball is uniquely identified with a number. The numbers used on the balls are in the range 1 to 6.

The large pool of balls is an infinite pool of balls, such that the probability of drawing any number is 1 in 6.

Rankings of numbers is defined by the game designer that 6 ranks above 5, ranks above 4, ranks above 3, ranks above 2, above 1. (Note that 1 is regarded strictly as 1 and not as an Ace which would rank above 6).

A player bets one credit.

Five balls are drawn from the infinite pool and these are the five numbers for the house. The result is 1, 2, 1, 3, 5.

Five balls are drawn from the infinite pool and these are the five numbers for the player. The result is 2, 3, 6, 4, 1.

The five numbers for the house and the player are compared to the ranking schedule.

The house has 1 pair (Pair of 1's); the player has no pattern defined on the schedule.

The house hand is ranked higher than the player's hand.

The player is now entitled to re-draw.

The player's hand has 4 to a straight (1, 2, 3, 4) so the player can re-throw the die which shows "6" with the aim of getting a "5" to from a straight or a 1, 2, 3, or 4 to form 1 pair.

Other re-draws are possible.

And so on in similar fashion to the above dice example.

Example 3

A game is played with ten cards initially drawn from an endless deck of a reduced pack of cards. The game is fair and each card has the values 9 to Ace shown on them.

Because the deck is endless and the draw is fair, the probability of drawing a particular value on a card is 1 in 6.

Rankings of cards is defined in the usual fashion with Ace higher than King higher than Queen higher than Jack higher than 10 higher than 9.

A player bets one credit.

Five cards are dealt to the house and reveal the numbers 9, 10, 9, Jack, King.

Five cards are dealt to the player and reveal the numbers 10, jack, Ace, queen, 9.

The five cards for the house and the player are compared to the ranking schedule.

And proceed as for the dice game where 6=Ace, 5=King, 4=Queen, 3=jack, 2=10, 1=9.

Persons skilled in the art will appreciate that other modifications and variations may be made without departing from the scope of the invention described herein.

It is to be understood that, if any prior art publication is referred to herein, such reference does not constitute an admission that the publication forms a part of the common general knowledge in the art, in Australia or any other country.

In the claims which follow and in the preceding description of certain embodiments of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A method of gaming for use with a gaming machine and a game controller, the method comprising:

conducting via the game controller a first play round comprising:

selecting at least one first symbol to form at least part of a first player hand comprised of a plurality of symbols;

selecting at least one second symbol to form at least part of a second player hand comprised of a plurality of symbols;

determining which of the hands has a lower ranking from the symbols of the hands; conducting via the game controller at least one subsequent play round comprising:

modifying the current lower ranked hand by replacing at least one symbol with at least one replacement symbol;

determining which of the first player hand and second player hand is ranked lower subsequent to the revision; and determining whether the game is completed or whether the game should proceed to a further subsequent play round based on a ranking of one of the first and second player hands being higher than the other of the first and second player hands for at least two consecutive play rounds.

2. A method as claimed in claim 1, and further comprising allocating a prize to a first player if the first player hand is ranked higher when the game is completed.

3. A method as claimed in claim 2, and further comprising selecting a plurality of first symbols and a plurality of second symbols that respectively form the whole first and second player hands.

4. A method as claimed in claim 2, and further comprising selecting at least one shared symbol shared by the first and second players to form their respective hands.

5. A method as claimed in claim 2, and further comprising determining a game to be completed if one hand is higher for two consecutive play rounds.

6. A method as claimed in claim 2, and wherein the symbols are symbols on dice.

7. A method as claimed in claim 2, and wherein each player obtains five symbols to form a hand.

8. A method as claimed in claim 2, and wherein if the first and second player hands have an equivalent ranking, the game is completed as a draw.

9. A method as claimed in claim 2, and wherein if the first and second player hands have an equivalent ranking, both the first and second players obtain at least one replacement symbol.

10. One or more non-transitory computer readable mediums embodying Computer program code which when executed by a computer causes the computer to carry out a computer implemented gaming method comprising:

conducting a first play round comprising: selecting at least one first symbol to form at least part of a first player hand comprised of a plurality of symbols;

selecting at least one second symbol to form at least part of a second player hand comprised of a plurality of symbols;

determining which of the hands has a lower ranking from the symbols of the hands; conducting at least one subsequent play round comprising:

modifying the current lower ranked hand by replacing at least one symbol with at least one replacement symbol;

determining which of the first player hand and second player hand is ranked lower subsequent to the revision; and determining whether the game is completed or whether the game should proceed to a further subsequent play round based on a ranking of one of the first and second player hands being higher than the other of the first and second player hands for at least two consecutive play rounds.

* * * * *